United States Patent [19]

Miffre

[11] 4,286,663

[45] Sep. 1, 1981

[54] HYDRAULIC PUMPING ROD CONNECTING AND DISCONNECTING DEVICE

[75] Inventor: Hubert Miffre, Elancourt, France

[73] Assignee: Societe Nationale Elf Aquitaine (Production), Courbevoie, France

[21] Appl. No.: 59,339

[22] Filed: Jul. 23, 1979

[30] Foreign Application Priority Data

Jul. 27, 1978 [FR] France ..... 78 22202

[51] Int. Cl.[3] ..... E21B 41/00

[52] U.S. Cl. ..... 166/325; 166/106; 166/217; 166/243; 417/450

[58] Field of Search ..... 166/216, 217, 214, 215, 166/136, 137, 325, 106, 212, 243; 417/448, 449, 450

[56] References Cited

U.S. PATENT DOCUMENTS

| | | | |
|---|---|---|---|
| 2,673,614 | 3/1954 | Miller | 166/216 |
| 3,863,715 | 2/1975 | Yonker | 166/217 |
| 4,023,620 | 5/1977 | Gazda et al. | 166/217 |
| 4,043,390 | 8/1977 | Glotin | 166/217 |
| 4,171,934 | 10/1979 | Zehren | 166/217 |

*Primary Examiner*—James A. Leppink

*Attorney, Agent, or Firm*—Brisebois & Kruger

[57] ABSTRACT

A pumping rod connecting and disconnecting device comprises: a lower production tubing column and an upper production tubing column having a larger diameter than that of the lower column; a connecting piece provided with a circular seat and a circular groove; a lower assembly mounted onto the upper end of a lower pumping rod column and provided with mounting and locking means, as well as with passage means arranged between the spaces located below and above the device; an upper assembly fixed to the lower end of an upper pumping rod column having a continuous axial conduit; and removable blocking means for blocking the locking means of the upper and lower assemblies, connected to a surface source of hydraulic pressure. The device can be used for pumping by means of floating pumping apparatus.

6 Claims, 3 Drawing Figures

HYDRAULIC PUMPING ROD CONNECTING AND DISCONNECTING DEVICE

The present invention relates to a pumping rod connecting and disconnecting device.

When the pumping operations of a well have to be interrupted for a long or indefinite period of time, it is current practice to raise the pump and the associated rod assembly to the surface so as to be able to check the pump and to perform any maintenance operation which might be desirable, whereby especially any sedimentation and clogging which would result from a prolonged interruption of operation are avoided.

However in certain conditions the interruption of the operation of the pump and of the mechanical connections between the subsoil pump and the pump driving mechanism installed at the surface must be very short, especially when the pumping is effected by means of floating devices. These devices must be adapted to be detached from the head of the well which is located on the sea bed, when the sea becomes too rough. A pumping or drilling rod disconnecting device in a well, permitting the various upper rod elements to be recovered and later reconnected must constitute a novel means for enhancing the safety of the pumping installations at sea.

Hydraulic devices for connecting and disconnecting the risers (i.e. tubular conduits) provided between the well head and the drilling platform, and also the disc or ball type safety valves are known. The known connecting and disconnecting devices must provide for a free axial passage and therefor comprise hydraulic control fluid conduits located at the outside of a so called annular space defined between the "tubing" (i.e. the protecting tube) and the casing of the well. This arrangement, which is satisfactory for stationary installations, cannot be used in association with the moving elements of a reciprocating pump.

It could be envisaged to construct mechanical connecting and disconnecting devices using the rotational motion of the rods from the surface, or the shock of an annular inertia block sent down from the surface; however certain pump failures can only be repaired by means developing similar mechanical forces, and under these conditions there would exist a considerable risk of disconnection.

The present invention permits alleviating these problems by utilizing, for connecting and reconnecting the displacement of a piston under the effect of a hydraulic pressure transmitted by a conduit arranged in the direction of the axis of the upper pumping rods.

A pumping rod connecting and disconnecting device according the present invention comprises.

a production tubing connecting a lower tube column to a higher tube column the inner diameter of which is larger than the inner diameter of said lower column, said connecting piece comprising a lower circular upwardly directed seat and an inner annular circular groove;

a lower pumping rod assembly affixed to the higher end of a lower column of pumping rods, said assembly being provided with positioning means, locking means provided within said connecting piece, removable locking and blocking means for ensuring said locking and comprising a passage placed above and below said device;

an upper assembly affixed to the lower end of an upper pumping rod assembly of the type comprising a conduit connecting said upper assembly to a source of hydraulic pressure at the surface, and provided with means for locking said upper assembly in said lower assembly;

and removable locking means for locking said blocking means adapted to connect said upper assembly to said lower assembly connected to said source of hydraulic pressure at the surface.

In certain embodiments of the invention the passage through the lower assembly between the spaces below and above the device is provided with removable closure means.

In a perferred embodiment of the invention the passage provided in the lower assembly between the spaces defined below and above the device is provided with removable closure means, constituted by a check valve which is maintained on its seat by a return spring and displaceable under the action of a rod extending below the upper assembly of the device.

In various embodiments the means of mounting the lower assembly in the connecting piece comprise a restricted portion provided between a higher portion and a lower portion of said lower assembly.

In a preferred embodiment of the invention the removable locking means for the blocking of the upper assembly in the lower assembly are constituted by a tool comprising at its upper end a piston exposed face of which constitutes a movable wall of a space connected to the source of hydraulic pressure at the surface, said tool further comprising a cylindrical portion constituting a downwardly directed shoulder upon which rests a return spring which rests on a stop of the upper assembly, said tool being adapted to move longitudinally between an upper position, or locking position, and a lower position, or unlocking position, under the action of the hydraulic pressure while the cylindrical wall maintains, in the locking position, the locking elements of the upper assembly in a circular groove provided in the inner cylindrical wall of the lower assembly.

In accordance with another feature of this embodiment, the removable locking means associated with the lower assembly in the connecting piece are constituted by a movable locking sleeve adapted to be displaced longitudinally between a locking position wherein said sleeve is maintained by the action of a return spring and a stop, and wherein an annular protuberance maintains the locking fingers in the internal circular groove of the connecting piece under the effect of the downwardly directed force towards an annular shoulder provided on a locking collar affixed to the upper assembly, said upper assembly comprising a plurality of fingers extending from said locking collar and being provided at their ends with protuberances adapted to displace upwardly the movable locking sleeve toward an unlocking position. The invention will be described in a more detailed manner herein below with reference to the appended figures which are given by way of illustration, but not of limitation.

Figure 1:
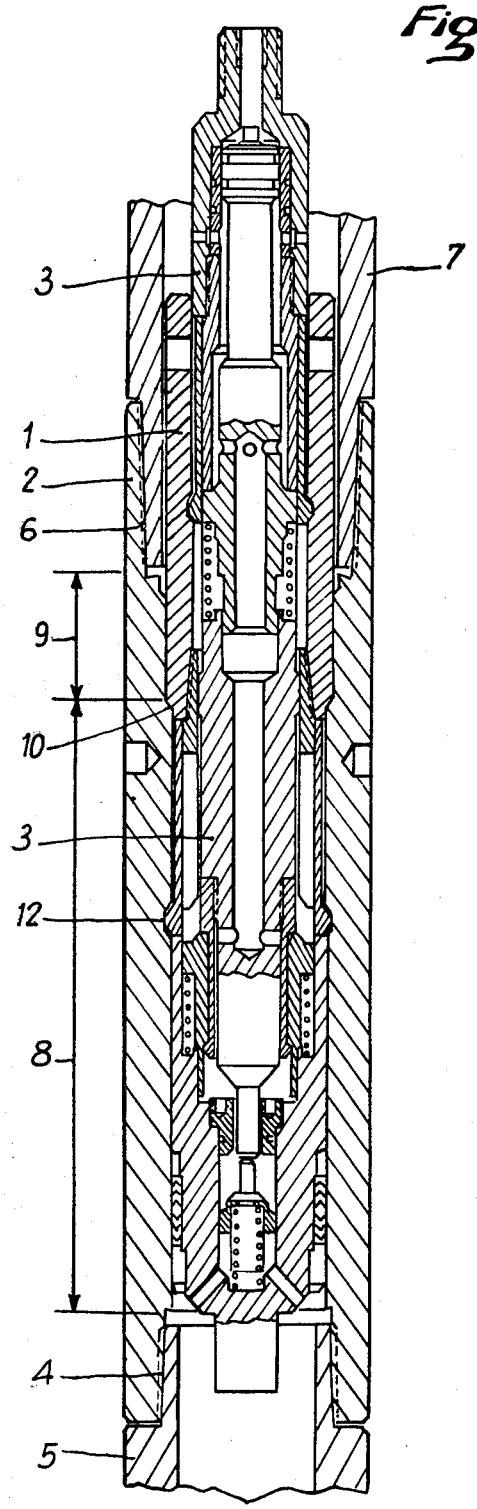
FIG. 1 shows in its entirety the device according to the invention immediately prior to the final connection phase.

FIG. 1 shows in longitudinal section a connecting and disconnecting device comprising a lower element 1 enclosed partially in a connecting piece 2 of a production tubing, which connecting piece constitutes a support for said lower element and an upper element 3 mounted partially in lower element 1 which constitutes a support for said upper element.

The connecting piece 2 of the production tubing is provided with an inner thread at its lower portion for fixing the upper end of a lower column 5 of the production tubing, and with a thread 6 provided at the upper portion of the connecting piece for fixing the lower end of an upper production tubing column 7.

The lower production tubing column 5 has an inner diameter smaller than the inner diameter of the upper production tubing column 7, for example, 112 mm. (to wit: 4.5") and 137 mm (to wit: 5.5"), respectively. Due to this arrangement, the connecting and disconnecting device is easily mounted and dismounted.

The inner diameter of connecting piece 2 is equal to that of the lower column 5 over a major portion 8 of its length, with the exception of an upper portion 9 located immediately below threading 6. Upper portion 9 joins portion 8 of the connecting piece by means of a frustroconical annular surface 10 constituting a seat for a frustroconical surface 11 having the same apex angle which is on the outer periphery of the lower element 1 of the device.

Connecting piece 2 also comprises in the median portion 8 an annular internal groove 12 having a trapezoidal section.

Figure 2:
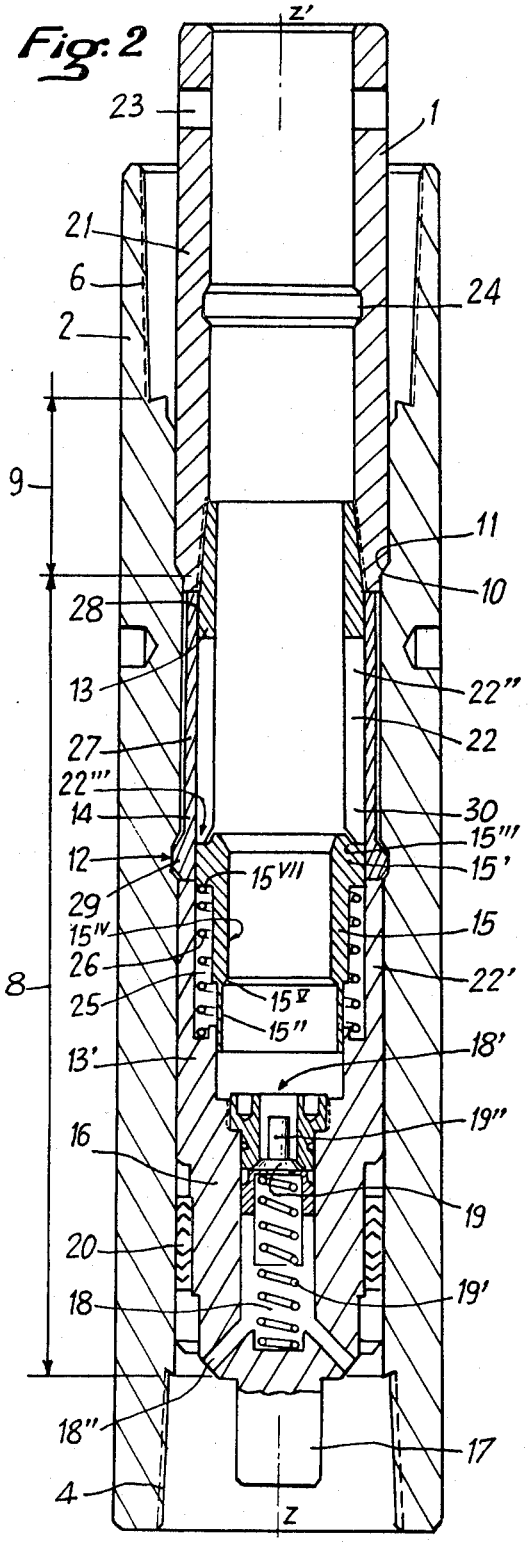
FIG. 2 is a longitudinal section of the lower element of the device, locked in the connecting piece of the tubing, after disconnection and withdrawal of the upper element.

The lower element 1 which, in accordance with FIG. 2, is located so as to be engaged, over the major portion of its length, within the connecting piece 2, comprises a tubular body 13 having an axis ZZ', on which a lock 14 know per se is mounted, and within which is a moveable locking sleeve 15. Tubular body 13 is mounted by its lower end 13' on a socket 16 followed by an axially entending threaded rod 17 adapted to be mounted onto the upper end of a plain pumping rod assembly known per se (not shown). Said socket comprises a passage 18 connecting the internal space of lower element 1 to the well space located below the device, said passage 18 being provided with a check valve 19; said socket further comprises sealing means 20 interposed between the external periphery of the socket proper and the internal periphery of connecting piece 2.

The tubular body 1 comprises an upper tubular sleeve 21 having an outer diameter slightly smaller than the inner diameter of the upper tubing 7, which tubular upper sleeve 21 is fixed by its lower end to a locking sleeve 22, by means of threads.

Near its lower end, tubular sleeve 21 has a constricted portion constituted by the frustoconical surface 11 having the same apex angle as that of the frustoconical surface 10 provided on the inner periphery of sleeve 2.

At its upper end portion, tubular sleeve 21 has at least one equalizing passage 23, while said sleeve comprises at its median portion an internal annular groove 24 of trapezoidal cross-section.

Locking sleeve 22 is constituted by a tubular sleeve divided into two portions of substantially equal lengths to wit: a lower portion 22' having an outer diameter slightly smaller than the inner diameter of the lower column, and an upper portion 22" having an outer diameter smaller than that of the lower portion 22'. The space provided by said reduced diameter portion contains the lock 14 constituted by a plurality of elastic fingers such as 27 extending from the periphery of a cylinder 28, each finger being provided at its end with an outer enlargement or protuberance 29 having a trapezoidal section in diametral plane and the same dimensions as those of the section of the trapezoidal groove 12. Such lock is known per se and has been described on pages 520 and 524 of the "Composite Catalog, 1976–1977" published by the BAKER OIL TOOL COMPANY.

The upper portion 22" of locking sleeve 22 is provided with longitudinal slots 30 the number of which corresponds to that of the fingers 27 of the lock, said longitudinal holes being so dimensioned that said fingers can penetrate these holes.

The upper portion 22" of sleeve 22, the inner diameter of which is larger than the inner diameter of the lower portion 22', is mounted onto the latter by means of an annular bearing surface 22''' located at the upper level of the protuberances 29.

The locking sleeve 15 of the locking fingers of lock 14 is mounted within the lower portion of locking sleeve 22 and comprises at its upper end an annular external protuberance 15' the outer diameter of which is slightly smaller than the inner diameter of portion 22', whereby said protuberance engages the inner face of the end of fingers 27 of the lock when the outer protuberances of said fingers are placed in groove 12 provided in the inner peripheral surface of connecting piece 2.

A return-spring 26 resting at one end on a planar end of an annular surface of socket 16 and at its other end on a planar surface 15" constituting the lower surface of the protuberance 15' of blocking sleeve 15 is placed in an annular space 25 delimited inwardly by a cylindrical surface forming part of the external periphery of sleeve 15, and delimited outwardly by a cylindrical surface constituting a part of the internal periphery of socket 16.

Blocking sleeve 15 extends downwardly to form a skirt 15" the outer diameter of which is slightly smaller than the inner diameter of the upper end portion of socket 16, and said skirt 15" is slidingly mounted in said end portion of the socket 16.

The internal periphery of blocking sleeve 15 constitutes a cylinder $15^{IV}$ which is terminated, at its upper end, by an annular bearing surface 15''' having a slightly increased diameter, said internal periphery of the skirt 15" being connected to the cylindrical surface $15^{IV}$ by a downwardly-directed frustoconical bearing surface $15^{V}$.

The inner passage 18 of socket 16 is connected to the inner space of the lower element 1 by an axial aperture 18' on which a check valve 19 is applied by a return spring 19' bearing at one of its ends on said check valve and at its other end on the wall of the passage 18 which is located opposite the aperture 18'.

Said check valve is provided by a circular rod 19" extending into the inner space of lower element 1. When an axial force opposed to that of return spring 19' is exerted on rod 19", check valve 19 will be unseated.

The inner passage 18 of socket 16 is connected to the inner space of the production tubing located below the device by at least one conduit 18" the axis of which defines with axis ZZ' of the device an angle sufficient for allowing said conduit (or conduits) 18" to open at a location (or locations) laterally outwardly of said threaded rod 17.

Figure 3:
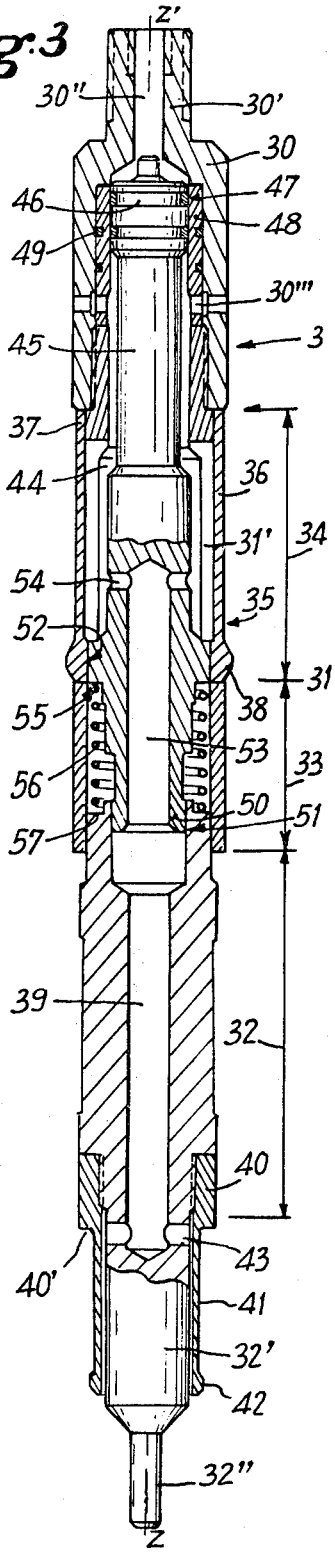
FIG. 3 is a longitudinal section of the upper element of the device during raising after disconnection.

FIG. 3 shows the upper element 3 which is constituted by three coaxial tubular bodies, to wit: an upper body 30 provided with a threaded end-piece 30' comprising an axial conduit 30'' for connection with the lower end of the upper hollow pumping rods (not shown), a median body 31 and a lower body 32 provided with a socket 32' which is terminated by a rod 32'' adapted to bear axially on the end of rod 19'' or check valve 19.

The upper body 30 has an outer diameter slightly smaller than the inner diameter of the upper tubular or positioning sleeve 21.

The median body 31 is constituted by a tubular sleeve comprising two parts, to wit: a lower part 33 having an outer diameter slightly smaller than the inner diameter of the upper tubular sleeve 21 (positioning sleeve) and an upper part 34 having an outer diameter smaller than that of the lower part 33. The space defined by this reduced diameter contains a lock 35 constituted by a plurality of elastic fingers such as 36 connected to the periphery of a cylindrical skirt 37 and each provided at its end with a protuberance 38 having a trapezoidal section as seen in a diametral plane, the respective dimensions of said protuberances being such that they correspond to those of the section of the trapezoidal groove 24 provided in the inner surface of the upper tubular sleeve 21. Such lock is known per se and has been disclosed, for example, on pages 520 and 524 of the "Composite Catalog" 1976–1977 published by the BAKER OIL TOOL COMPANY.

The upper part 34 of the median body 31 is provided with longitudinal slots or apertures 31' the number of which corresponds to that of the fingers 36, said apertures being so dimensioned that said fingers can penetrate the same.

The lower body 32 is of a tubular shape in its main portion and has an outer diameter slightly smaller than the inner diameter of tubular body 13. This tubular portion, which is provided with an axial conduit 39 supports at its lower end a skirt 40 having an inner diameter equal to that of the tubular portion. This skirt 49, which may be named "locking collar", delimits in the downward direction an annular bearing surface 40' having a reduced diameter, and is associated with a plurality of elastic fingers such as 41. These fingers, such as shown at 41, are provided at their respective ends with outwardly extending protuberances 42 each having a trapezoidal cross-section, as seen in a diametral plane, with one face directed upwardly, and which is adapted to engage the downwardly directed frustoconical bearing surface 15$^{V}$ of the blocking sleeve 15. Fingers 40 are more flexible and less heavy than the locking fingers 27 and 35.

The outer diameter of the cylinder constituting the envelope of the elastic fingers 41 is slightly smaller than the inner diameter of blocking sleeve 15.

Lower body 32 is provided with a socket 32' which has at its upper portion a diametral passage or conduit 43 connected to axial conduit 39 for establishing the communication between the inner space of lower element 32 and the lower space of the well.

Upper body 30 is provided with at least one diametral conduit or passage such as 30''' adapted to establish the communication between the inner space of the upper element 3 and the annular space defined between the latter and the lower element 1.

Coaxial tubular bodies 30, 31 and 32, which form the upper element 3, delimit an inner space 44 wherein a tool 45 is axially displaceable.

Tool 45 is constituted by a rod disposed coaxially with reference to upper element 3 and provided, at its upper end, with a piston 46 tightly mounted and longitudinally displaceable in a polished cylinder 47 which, in the present embodiment, and for reasons of facilitating manufacture, is defined by a sleeve 48 connected to the inner space of upper element 3 with an interposed sealing element 49; tool 45 also has at its lower end a guiding piston 50 longitudinally displaceable in a cylinder 51 disposed in the upper part the lower body 32 of upper element 3.

On the lower third of its length, tool 45 has a protruding cylindrical bearing surface 52 the diameter of which is so selected that when said bearing surface 52 engages the inner surface of the protuberances 38 of fingers 37 of lock 35, said protuberances 38 engage by their frustoconical bearing surfaces the frustoconical groove 24 provided on the inner cylindrical periphery of lower body 1.

The lower portion of tool 45 is provided with an axially extending conduit 53 opening into axial conduit 39 of lower body 32, and conduit 53 has at its upper end a horizontal passage 54 located above said cylindrical bearing surface 52. Axial conduit 53 and passage 54 establish a permanent connection between the lower body 32 and the upper part of the internal space of upper body 3, and also with the upper internal space of body 1.

Cylindrical bearing surface 52, the diameter of which is larger than that of the tool assembly, is delimited at its lower end by an annular shoulder 55 on which bears a spring 58 the opposite end of which bears on an annular bearing surface 57 of the lower body 32.

Tool 45 is moveable by translation between an upper position wherein it is maintained by the action of spring 56 when no hydraulic pressure is applied through conduit 30'' (in which position upper element 3 is connected to lower element 1) and a lower position, wherein element 3 is disconnected from lower element 1 under the action of a hydraulic pressure transmitted by conduit 30'' and the axial passage or conduit of the upper pumping rods.

OPERATION OF THE DEVICE ACCORDING TO THE INVENTION

I. Disconnecting

The connecting and disconnecting device described herein above operates as follows:

A reciprocating piston pump operates by displacement of the moveable assembly between an upper dead center and a lower dead center.

When a connecting and disconnecting device is interposed in a pumping rod assembly the lower dead center is so located that the entire device is located above the positioning sleeve within the upper tubing, which has an inner diameter larger than that of the lower tubing.

In the connecting position and during pumping, fingers 27 of lock 14 are in their normal position without any elastic stress, and moveable blocking sleeve 15 is in its low position wherein it is maintained under the action of annular bearing surface 40' of skirt 40 ("locking skirt"). The return spring 56 is compressed.

In the connecting position, rod 32'' constituting the lower end of the upper element 3, engages the upper end of rod 19'' of check valve 19 so as to maintain the same unseated.

With a view to disconnecting:

the rods are lowered below the lower dead center of the pump, until the lower element of the device rests in the tubing connection piece by engagement of frustoconical surface 11 defined on the outer periphery of lower element 1, and corresponding frustoconical bearing surface 10 of the tubing connecting piece.

When, during the lowering motion, the outer protuberances 29 of fingers 27 engage the frustoconical surface 10, said fingers 27 will be deformed toward the inside of the device, so as to be placed into the longitudinal apertures 30. The protuberances 29 then bear on the inner periphery of the tubing connecting piece 2.

When frustoconical surface 11 engages frustoconical bearing surface 10, the outer protuberances 29 of fingers 27 penetrate annular groove 12 under the action of the elastic force of fingers 27.

A hydraulic pressure is then applied to the device from the surface through the axial conduit provided in the upper rods and conduit 30'' located axially in the threaded end piece 30' of upper body of upper element 3.

Said hydraulic pressure is applied onto piston 46 and overcomes the opposed force exerted by spring 56, thus causing the entire tool 45 to be longitudinally displaced in the downward direction.

Since the cylindrical bearing surface 52 of tool 45 has been moved downwardly, said surface no longer engages the inner face of fingers 36 of lock 35, whereby these fingers are set free.

The pressure equilibrium between the various spaces is maintained by the conduits interconnecting said spaces, to wit: conduits 39 and 43 provided in the lower body 32 of tool 45, conduit 30' provided in the upper body 30 of tool 45, and conduit 23 provided in the upper cylindrical sleeve 21 of lower element 1.

A traction or pulling force is then exerted on the upper rods; fingers 36 of lock 35 then penetrate the apertures 31' and upper element 3 is separated from lower element 1, while the latter is still maintained in connecting piece 2.

During the upwardly directed displacement of upper element 3 the protuberances 42 of fingers 41 which constitute an extension of skirt 40 (locking collar) in the downward direction engage bearing surface 15$^{V}$ of blocking sleeve 15. Under the combined effect of protuberances 42 and spring 26 the blocking sleeve is displaced upwardly and blocks fingers 27 of lock 14 in the locking position. Sleeve 15 is blocked in the upward direction by bearing on the downwardly directed bearing surface 22''', which connects the lower part 22' to the upper part 22'' of sleeve 22.

Fingers 41 are then displaced and pass through blocking sleeve 15.

The hydraulic pressure at the surface and within upper element 3 is stopped and tool 45 moves back into its upper position under the action of return spring 56.

Due to the displacement of upper element 3 in the upward direction, and due to its disengagement from lower element 1, the end of rod 32'' is disengaged from the upper end of rod 19'', whereby valve 19 is raised under the action of spring 19', said check valve being closed and the space located above lower element 1 is isolated from the space located below, which constitutes a supplementary security during the interruption of pumping, especially when the well contains a comparatively high percentage of gas dissolved in the oil.

II. Re-connection

While the lower element 1 of the connecting and disconnecting device is in position within connecting piece 2, check valve 19 being closed, the pumping rods are re-connected as follows:

The downward displacement of the upper rod assembly provided with a continuous axial conduit and associated to upper element 3 of the connecting and disconnecting device is started, and at the same time:

Pressure is applied from the surface to the axial conduit of the upper rods, whereby tool 45 is displaced downwardly and fingers 36 of lock 35 are unlocked.

When upper element 3 penetrates lower element 1 the protuberances 38 of fingers 36 engage the inner periphery of upper tubular sleeve 21 and the fingers are deformed so that upper element 3 can continue its displacement.

The downward displacement of the rod assembly is continued until upper element 3 rests on lower element 1.

While upper element 3 is being put in place within lower element 1, the end of rod 32 is moved into engagement with the upper end of rod 19'' of check valve 19. Check valve 19 opens and thus causes the pressures prevailing within the spaces located, respectively, above and below the device to be balanced. The downward motion of upper element 3 is continued. Annular bearing surface 40' of skirt 40 ("locking collar") engages the upper bearing surface 15''' of blocking sleeve 15 and then lowers said blocking sleeve, whereby fingers 27 of lock 14 can be deformed.

When the upper element has reached its seating position within lower element 1, the protuberances 38 of fingers 36 penetrate groove 24.

The hydraulic pressure applied through the conduit of the upper rods is cut off, whereby tool 45 is raised to its upper position within upper element 3.

This displacement causes fingers 36 of the lock to be blocked.

A traction force is then exerted on the rods, whereby fingers 27 of lock 14 are retracted.

the re-connection operation is completed by raising the rod assembly to its position corresponding to the low dead center of the pump.

It is now possible to summarize the advantages of the rod connecting and disconnecting device according to the invention as follows:

Each one of the elementary operations can be discontinued without any danger to the security of the material. Indeed, due to the provision of three return springs the blocking of the locks between upper element 3 and lower element 1, and then between lower element 1 and the connecting piece will result from any interruption of an operation or intervention. This also applies to the operation of the check valve.

The position of this valve allows the installation to be abandoned without any danger after complete removal of the upper pumping rods; it is also possible to effect pumping through the installation, with a view to neutralizing the well, if necessary.

The invention is not limited to the embodiments shown and described herein-above; many modifications and variants may be envisaged by those skilled in the art within the scope of the invention as defined in the appended claims.

What is claimed is:

1. A pump rod connecting device for connecting an upper column of pump rods to a lower column of pump rods, and for disconnecting the upper pump rod column from the lower column comprising:

a tubular production tubing connecting piece connected between upper and lower columns of production tubing, said connecting piece comprising a circular upwardly directed seat and an internal annular circular groove;

a connector comprising an upper assembly and a lower assembly;

means for securing said upper assembly to a lower end of the upper column of pump rods;

means for securing said lower assembly to an upper end of the lower column of pump rods;

said lower assembly of said connector means for positioning the lower assembly in said connecting piece, comprising locking means for locking said lower assembly in said connecting piece, and means for blocking said locking means, said lower assembly further having passage means for communicating said upper tubing column with said lower tubing column;

said upper assembly of said connector comprising means for locking said upper assembly to said lower assembly;

means for moving said blocking means to a position in which said locking means of the lower assembly is unlocked from said connecting piece, and hydraulically operated remotely controlled means for releasing said locking means for connecting said upper assembly to said lower assembly so that the upper column of pump rods and said upper assembly secured thereto can be removed from the lower assembly.

2. The device of claim 1, wherein said passage in the lower assembly is provided with movable closure means.

3. The device of claim 2, wherein said movable closure means comprises a check valve which is maintained on its seat by a return spring and is displaceable to an open position by a rod extending downwardly from said upper assembly.

4. The device of claim 1, wherein said means for positioning said lower assembly in the connecting piece comprises a restricted portion between an upper and a lower portion of said lower assembly.

5. The device of claim 1, wherein the movable blocking means for locking the upper assembly in the lower assembly comprises a tool having at its upper end a piston the exposed face of which constitutes a movable wall of a chamber connected to a source of hydraulic pressure at the surface, said tool further comprising a cylindrical portion and a downwardly directed shoulder upon which bears a return spring which rests on another shoulder of the upper assembly, said tool being movable longitudinally between an upper locking position and a lower unlocking position under the action of the hydraulic pressure, said cylindrical portion, in the locking position, maintaining the locking elements of the upper assembly locked in a circular groove in the inner cylindrical wall of the lower assembly.

6. The device of claim 1, wherein the means for blocking the locking means of the lower assembly in the connecting piece comprises, a movable locking sleeve displaceable longitudinally to a locking position in which said sleeve is maintained by the action of a return spring and a stop, and an annular protuberance of the sleeve maintains locking fingers of the lower assembly in the internal circular groove of the connecting piece, said upper assembly comprising a plurality of fingers extending from a locking collar and being provided at their ends with protuberances adapted to assist displacing the movable locking sleeve upwardly toward the locking position.

* * * * *